US007128610B1

(12) United States Patent
Chiang

(10) Patent No.: US 7,128,610 B1
(45) Date of Patent: Oct. 31, 2006

(54) SHIELDED ANTENNA CONNECTOR

(75) Inventor: Shu-Man Chiang, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/373,241

(22) Filed: Mar. 13, 2006

(51) Int. Cl.
*H01R 13/648* (2006.01)
*H01R 24/00* (2006.01)
*H01Q 1/24* (2006.01)

(52) U.S. Cl. ..... 439/607; 439/675; 439/916; 343/906

(58) Field of Classification Search ..... 439/578, 439/675, 607, 609, 916; 343/906, 702
See application file for complete search history.

(56) References Cited

U.S. PATENT DOCUMENTS 5,278,570 A * 1/1994 Jaramillo et al. ..... 343/702
5,835,071 A 11/1998 Phelps
6,140,977 A * 10/2000 Morales et al. ..... 343/906
6,471,546 B1 * 10/2002 Zhu et al. ..... 439/607
6,574,855 B1 * 6/2003 Hida ..... 29/622

* cited by examiner

*Primary Examiner*—Hien Vu
(74) *Attorney, Agent, or Firm*—Birch, Stewart, Kolasch & Birch, LLP

(57) ABSTRACT

A shielded antenna connector includes an insulating housing defining an electrical terminal receiving cavity therein, an electrical terminal received in the terminal receiving cavity, and a shield covering the insulating housing. A receiving space is formed between the shield and the insulating housing and configured to receive an antenna. The electrical terminal has a contact portion extending upwardly into the receiving space to electrically contact the antenna. Latch means is defined between the shield and the insulating housing for securing the shield to the insulating housing firmly. A pair of elastic pressing pieces is defined in the shield and slopes into the receiving space to compress the antenna tightly.

6 Claims, 4 Drawing Sheets

SHIELDED ANTENNA CONNECTOR

BACKGROUND OF THE INVENTION

1. Field of the Invention

The present invention relates to a shielded antenna connector, and more particularly to a shielded antenna connector having improved supporting structure for stable electrical connection to an antenna.

2. The Related Art

An antenna is an essential part of a mobile phone. When the antenna is an outer antenna, an antenna connector is necessary to electrically connect the antenna with an inner printed circuit board of the mobile phone. However, the antenna is a sensitive component for sending and receiving messages. The antenna is easy to be interfered by interferences such as the position of the mobile phone, the connection condition between the antenna and the printed circuit board, and the ground shield. Therefore, the antenna designed with a shield for shielding the interferences comes with the tide of fashion.

U.S. Pat. No. 5,835,071 describes a shielded antenna connector providing a shield ground and RF connector for interconnections between an antenna and a printed circuit board. The shielded antenna connector includes a housing. An insulated connector insert is inserted into the housing and defines a chamber therebetween for receiving a retractable antenna. A shaped metal contact is inserted into the insulated connector insert. The shaped metal contact is electrically connected to the outer antenna, as a result, the antenna is electrically connected to the printed circuit board of the mobile phone. The housing act as a ground shield and surrounds the antenna so as to isolate the interferences outside.

However, when the antenna is stretched or retracted, the antenna is easy to loosen in the housing and the electrical connection between the antenna and the shaped metal contact is unstable, therefore, it is unstable when the antenna sending or receiving messages, and the communication of the mobile phone is affected.

SUMMARY OF THE INVENTION

Accordingly, an object of the present invention is to provide a shielded antenna connector having an insulating housing defining an electrical terminal receiving cavity therein, a shield covering the insulating housing to form a receiving space therebetween, and an electrical terminal received in the terminal receiving cavity. The electrical terminal has a contact portion extending upwardly beyond the insulating housing and into the receiving space. The receiving space is configured to receive an antenna that is adapted to electrically contact the contact portion. Latch means is defined between the shield and the insulating housing for securing the shield to the insulating housing firmly. A pair of elastic pressing pieces is defined in the shield and slopes into the receiving space to compress the antenna tightly. Thus the antenna is hard to loosen and the electrical connection between the antenna and the electrical terminal is stable, therefore, it is stable when the antenna sending or receiving messages, and the communication of the mobile phone is good.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
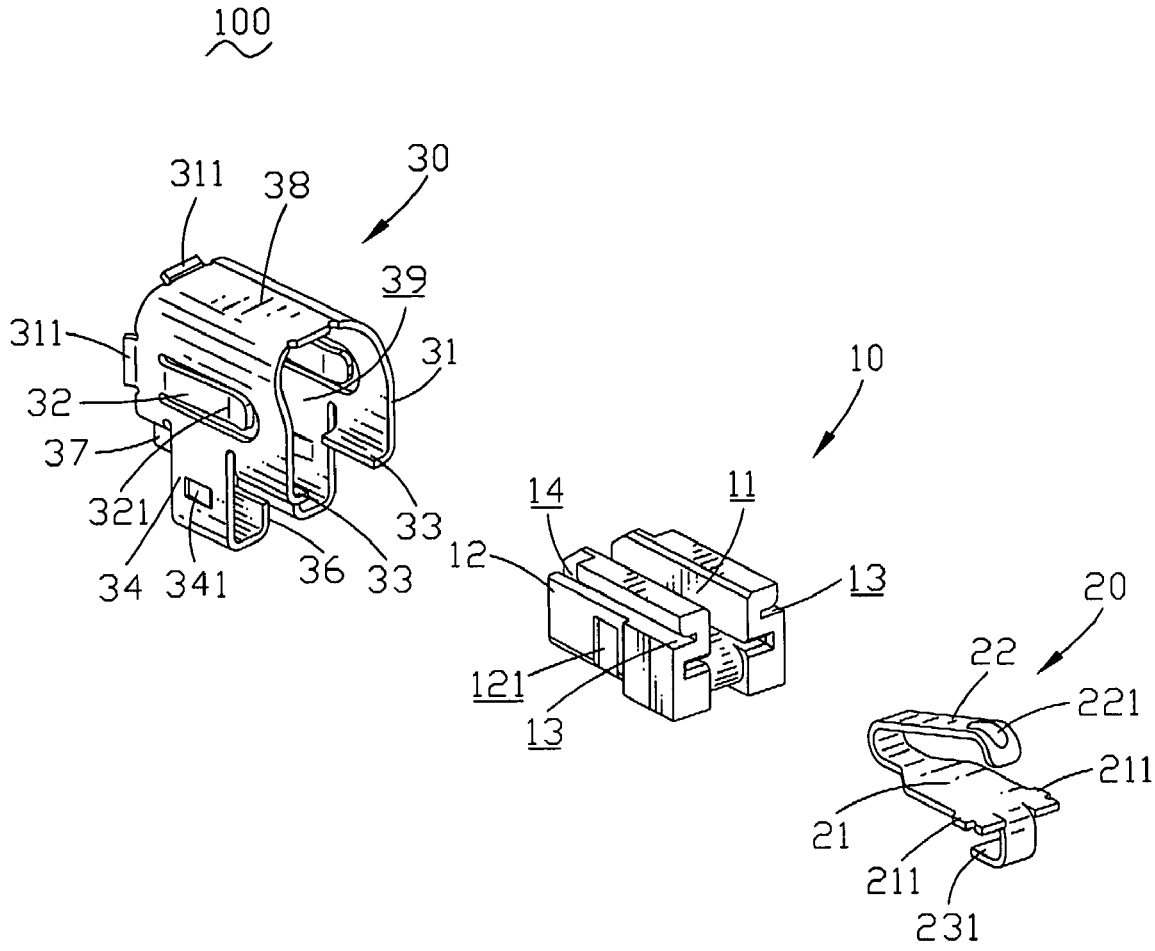
FIG. 1 is an exploded perspective view of a shielded antenna connector according to the present invention, comprising an insulating housing, an electrical terminal, and a shield.
Figure 2:
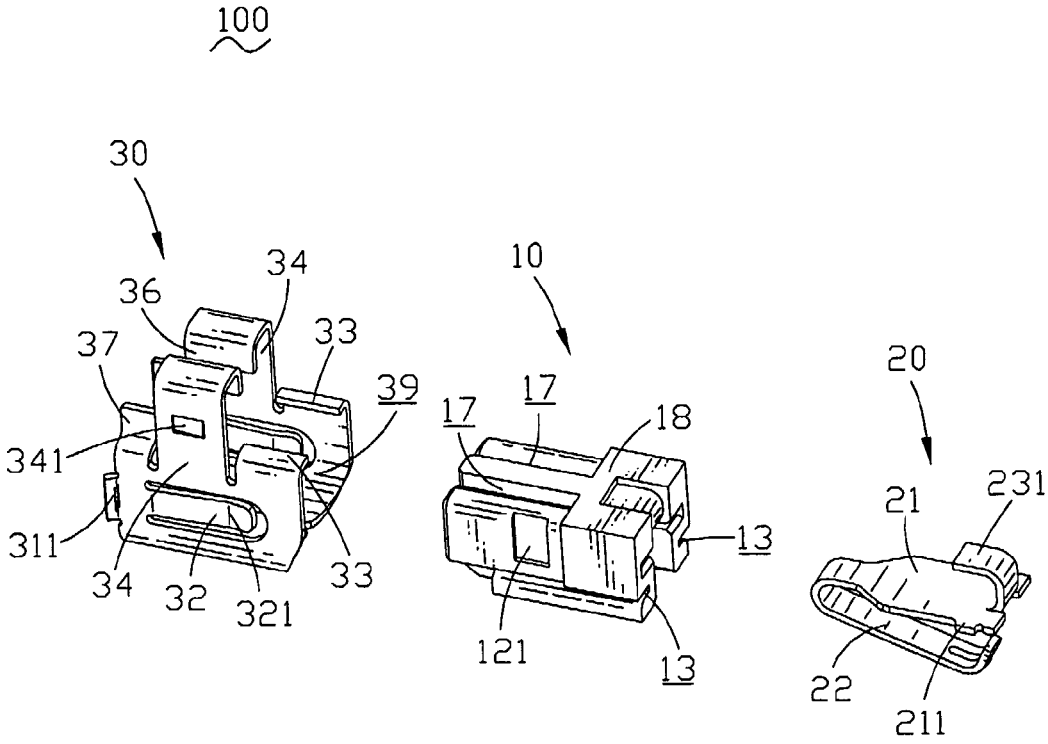
FIG. 2 is another exploded perspective view of the shielded antenna connector.
Figure 3:
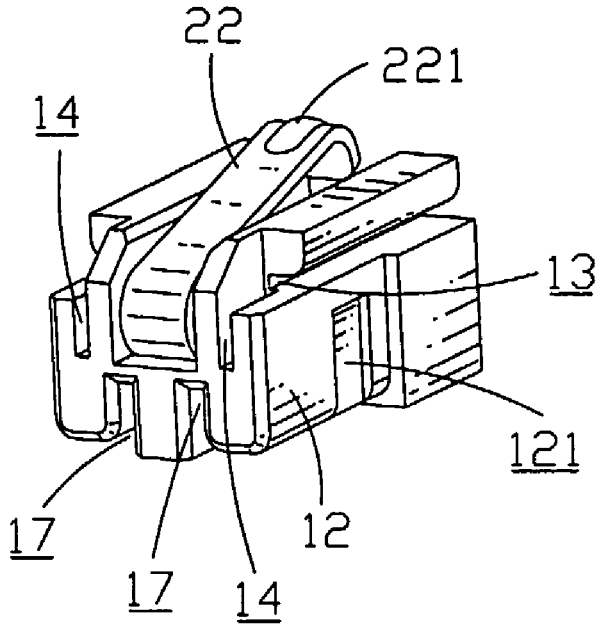
FIG. 3 is an assembled perspective view of the insulating housing and the electrical terminal.
Figure 4:
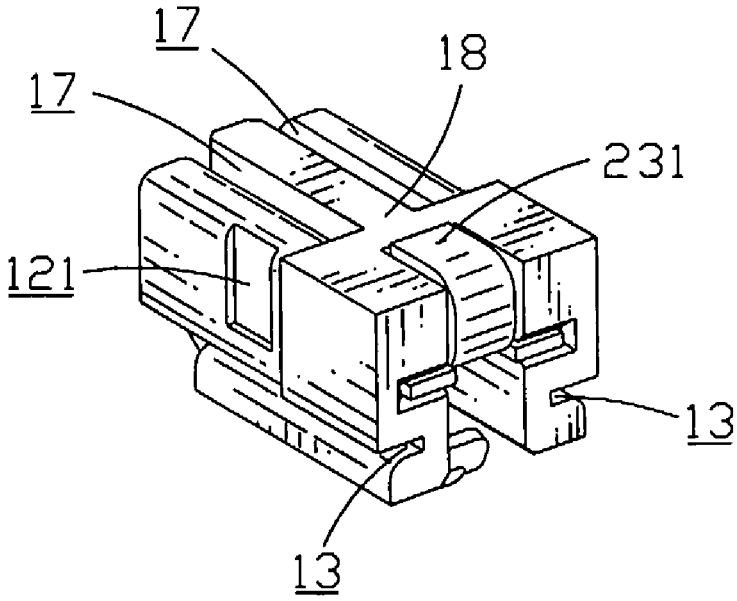
FIG. 4 is another assembled perspective view of the insulating housing and the electrical terminal.
Figure 5:
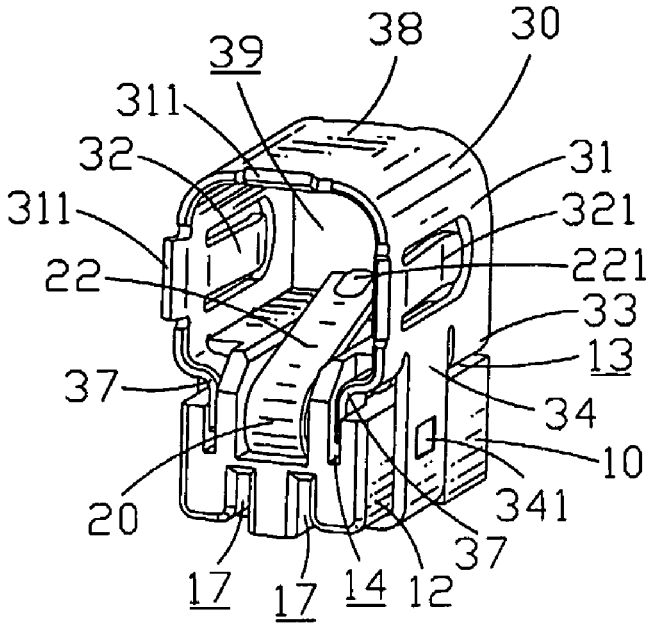
FIG. 5 is an assembled perspective view of the shielded antenna connector.

First referring to FIGS. 1–2, a shielded antenna connector 100 according to the present invention comprises an insulating housing 10, a shield 30 covering the insulating housing 10, and an electrical terminal 20 disposed in the insulating housing 10. Latch means is defined between the shield 30 and the insulating housing 10 for securing the shield 30 to the insulating housing 10 firmly.

The insulating housing has two sidewalls 12 and a bottom wall 18. A terminal receiving cavity 11 is defined between the two sidewalls 12 and the bottom wall 18. A pair of inlay grooves 13 is defined extending through the two sidewalls 12 from rear to front. The top surface of each sidewall 12 defines a vertical retaining groove 14 opening to back. The middle portion of the sidewall 12 defines a recess 121. The bottom surface of the bottom wall 18 of the insulating housing 10 defines a pair of slots 17 paralleling to each other.

The electrical terminal 20 comprises a plane board 21. Each of two sides of the front end of the plane board 21 forms a barb 211, and the middle of the front end of the plane board 21 bends downward and then backward to define a soldering portion 231. The back end of the plane board 21 extends upwards and beyond the front end of the plane board 21 to define an elastic board 22. The free end of the elastic board 22 bends downward and defines a contact portion 221 at the turning point.

The shield 30 comprises a top plate 38, two side plates 31 bending downward from two opposite sides of the top plate 38. Back ends of the two side plates 31 and the top plate 38 have portions extending backward and outwardly to define several oblique piece 311 respectively for facilitating guiding the insertion of an outer antenna. The shield 30 covers the insulating housing 10 with a receiving space 39 formed therebetween. The receiving space 39 is configured to receive an antenna 40. The top of each side plate 31 defines an elastic pressing piece 32 sloping into the receiving space 39. The free end of the elastic pressing piece 32 bends outward and defines a pressing portion 321 at the turning point. The bottom of the front portion of the side plate 31 bends inward and defines an inlay piece 33 for engaging with the inlay groove 13 of the insulating housing 10. The middle portion of the side plate 31 extends downward and defines a clamp 34 to clamp the sidewall 12 of the insulating housing 10. The center of the clamp 34 depressed and forms a hook 341 for engaging with the recess 121 of the insulating housing 10. The distal end of the clamp 34 bends inward horizontally and then upward to form a first vertical piece 36 for engaging with the slot 17 of the insulating housing 10. The bottom of the back portion of the side plate 31 extends inward horizontally and then downward to define a second vertical piece 37 for engaging with the retaining groove 14 of the insulating housing 10. It can be seen that the inlay piece 33 engaging with the inlay groove 13, the clamp 43 engaging with the sidewall 12, and the second vertical piece 37 engaging with the retaining groove 14 respectively act as latch means to secure the shield 30 to the insulating housing 10.

Please refer to FIGS. 1–5. The assemblage of the shielded antenna connector 100 of the present invention is described hereinafter in detail.

With reference to FIGS. 1–4, the plane board 21 of the electrical terminal 20 is inserted into the terminal receiving cavity 11 of insulating housing 10 from the front end thereof, and the barbs 211 interferely fit with the terminal receiving cavity 11. The elastic board 22 extends out of the terminal receiving cavity 11 and beyond the insulating housing 10. The soldering portion 231 of the electrical terminal 20 is received in the terminal receiving cavity 11 and generally flush with the bottom surface of the insulating housing 10 for being soldered to a printed circuit board of a mobile phone.

Referring to FIGS. 1–2 and FIG. 5 again, firstly, the inlay pieces 33 of the shield 30 slide into the inlay grooves 13 of the insulating housing 10, and the first vertical pieces 36 of the shield 30 are inserted into the slots 17 of the insulating housing 10, then the second vertical pieces 37 are inserted into the vertical retaining grooves 14, finally, the hooks 341 of the shield 30 engage with the recesses 121 of the insulating housing 10. Thus the shield 30 is secured to and covered on the insulating housing 10, and the shielded antenna connector 100 is assembled. In assembly, the contact portion 221 of the electrical terminal 20 and the pressing portions 321 of the shield 30 all slope into the receiving space 39.

Figure 6:
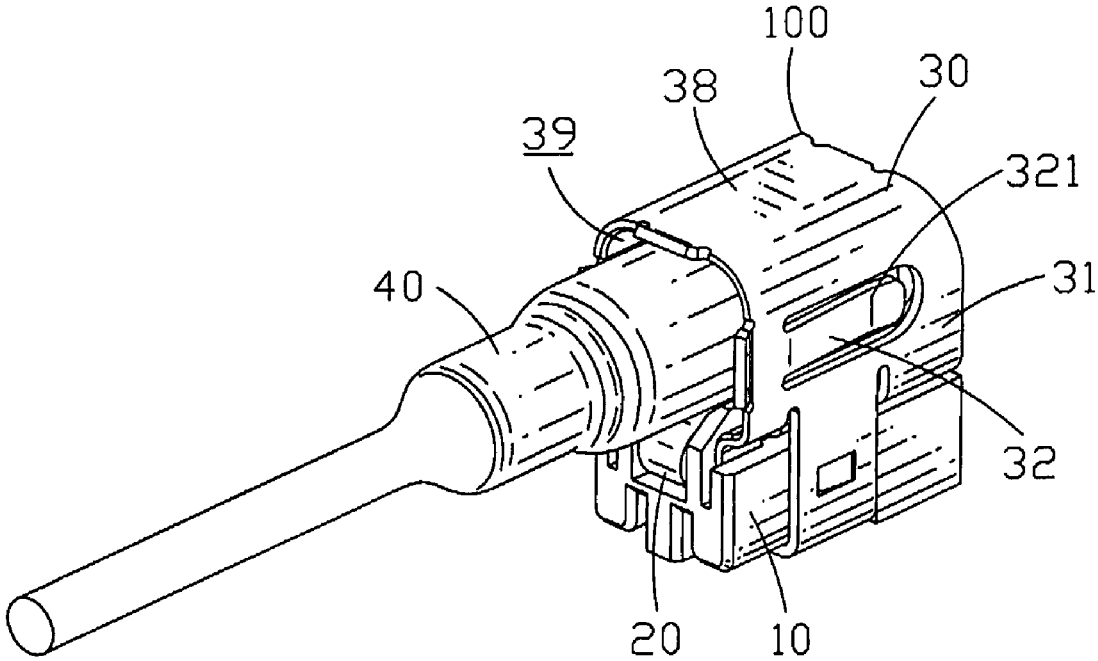
FIG. 6 is a perspective view of the shielded antenna connector, also showing an antenna inserted into the shielded antenna connector.

Please refer to FIG. 6. When the antenna 40 is inserted into the receiving space 39, the contact portion 221 of the electrical terminal 20 presses a feed-in point at the bottom of the antenna 40 and makes electrical connection therebetween, and the pressing portions 321 of the elastic pressing piece 32 compress the antenna 40 tightly. Therefore, the antenna 40 is stably received in the receiving space 39. When the antenna 40 is stretched or retracted in the shielded antenna connector 100, the antenna 40 is compressed by the elastic board 22 and the two elastic pressing pieces 32, as a result, the antenna 40 is hard to loosen, it is stable when the antenna 40 sending or receiving messages, and the communication of the mobile phone is good.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A shielded antenna connector comprising:

an insulating housing defining an electrical terminal receiving cavity therein;

an electrical terminal received in the terminal receiving cavity, the electrical terminal having a contact portion extending upward beyond the insulating housing; and a shield covering the insulating housing, a receiving space being defined between the shield and the insulating housing with said contact portion of said electrical terminal extending thereinto, said receiving space being configured to receive an antenna which is adapted to electrically contact said contact portion;

wherein a pair of elastic pressing pieces is defined in the shield and slopes into the receiving space to compress tightly said antenna;

wherein latch means is defined between the shield and the insulating housing for securing the shield to the insulating housing firmly;

wherein the insulating housing has two sidewalls and a bottom wall, said terminal receiving housing has two sidewalls and a bottom wall, said terminal receiving cavity is defined between the two, sidewalls and the bottom wall, the shield comprises a top plate and two side plates bending downward from two opposite sides of the top plate to latch to the sidewalls of the insulating housing respectively;

wherein the latch means comprises a pair of inlay pieces each formed by bending inward from a front bottom portion of each of the side plates and a pair of inlay grooves in outer surfaces of the two sidewalls extended from a front end to a rear end of the insulating housing, said inlay pieces slide into the inlay grooves respectively.

2. The shielded antenna connector as claimed in claim 1, wherein the latch means further comprises a pair of clamps extending downward from middle bottom portions of the side plates to clamp the sidewalls of the insulating housing.

3. The shielded antenna connector as claimed in claim 2, wherein each said clamp forms a hook thereon, and each said sidewall defines a recess therein for interference engagement with the hook.

4. The shielded antenna connector as claimed in claim 2, wherein a bottom surface of the bottom wall of the insulating housing defines a pair of parallel slots, and distal ends of the clamps bend inward horizontally and then upward to form a pair of first vertical pieces for engaging with the parallel slots of the insulating housing.

5. The shielded antenna connector as claimed in claim 1, wherein the latch means further comprises a vertical retaining groove formed in a top surface of each said sidewall and opening to back and a second vertical piece formed by extending a back bottom portion of each said side plate inward horizontally and then downwardly for engaging with the vertical retaining groove of the insulating housing.

6. The shielded antenna connector as claimed in claim 1, wherein a front end of the electrical terminal bends downward and then backward to form a soldering portion flush with the bottom surface of the bottom wall of the insulating housing.

* * * * *